US007758934B2

(12) United States Patent
Bays et al.

(10) Patent No.: US 7,758,934 B2
(45) Date of Patent: Jul. 20, 2010

(54) DUAL MODE INK JET PAPER

(75) Inventors: Lyle A. Bays, Ridgefield, WA (US); Bruce J. Kokko, Neenah, WI (US); Michael A. Schmelzer, Appleton, WI (US); Gary L. Schroder, Neenah, WI (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 0 days.

(21) Appl. No.: 12/171,587

(22) Filed: Jul. 11, 2008

(65) Prior Publication Data

US 2009/0017235 A1 Jan. 15, 2009

Related U.S. Application Data

(60) Provisional application No. 60/949,654, filed on Jul. 13, 2007.

(51) Int. Cl.
*B41M 5/40* (2006.01)

(52) U.S. Cl. ..... 428/32.21; 428/32.22; 428/32.34; 428/323; 428/537.5; 162/134; 162/135; 162/136; 162/137; 162/175; 162/181.2; 162/181.3; 162/184; 162/265

(58) Field of Classification Search ..... 428/32.1, 428/32.22, 32.34, 323, 537.5, 32.21; 161/134, 161/135, 136, 137, 175, 181.2, 181.3, 184, 161/265
See application file for complete search history.

(56) References Cited

U.S. PATENT DOCUMENTS

| | | | | |
|---|---|---|---|---|
| 2,527,563 | A | | 10/1950 | McEwen |
| 2,929,154 | A | | 3/1960 | Finnegan |
| 3,556,932 | A | | 1/1971 | Coscia et al. |
| 3,556,933 | A | | 1/1971 | Williams et al. |
| 3,793,279 | A | | 2/1974 | Lipowski |
| 4,012,334 | A | | 3/1977 | Raleigh et al. |
| 4,239,592 | A | | 12/1980 | Gaspar et al. |
| 4,522,686 | A | | 6/1985 | Dumas |
| 4,551,385 | A | | 11/1985 | Robbart |
| 4,892,590 | A | | 1/1990 | Gill et al. |
| 5,180,624 | A | | 1/1993 | Kojima et al. |
| 5,223,090 | A | | 6/1993 | Klungness et al. |
| 5,338,597 | A | | 8/1994 | Kurabayashi et al. |
| 5,474,843 | A | | 12/1995 | Lambert et al. |
| 5,562,974 | A | | 10/1996 | Kuroyama et al. |
| 5,620,793 | A | | 4/1997 | Suzuki et al. |
| 5,759,349 | A | | 6/1998 | Foster et al. |
| 5,846,308 | A | * | 12/1998 | Lauzon ..... 106/218 |
| 5,895,542 | A | | 4/1999 | Wadzinski |
| 5,904,775 | A | | 5/1999 | Salo et al. |
| 5,916,418 | A | | 6/1999 | Frank et al. |
| 6,039,799 | A | | 3/2000 | Kawamura et al. |
| 6,106,902 | A | | 8/2000 | Koskinen et al. |
| 6,123,760 | A | | 9/2000 | Varnell |
| 6,162,328 | A | | 12/2000 | Cenisio et al. |
| 6,207,258 | B1 | | 3/2001 | Varnell |
| 6,261,368 | B1 | | 7/2001 | Wight |
| 6,284,099 | B1 | | 9/2001 | Peutherer et al. |
| 6,312,794 | B1 | | 11/2001 | Sekiguchi et al. |
| 6,316,060 | B1 | | 11/2001 | Elvidge et al. |
| 6,326,323 | B1 | | 12/2001 | Shimano et al. |
| 6,383,612 | B1 | | 5/2002 | Waller, Jr. et al. |
| 6,387,506 | B1 | | 5/2002 | Kawamura et al. |
| 6,464,832 | B2 | | 10/2002 | Engelhardt et al. |
| 6,492,005 | B1 | | 12/2002 | Ohbayashi et al. |
| 6,660,369 | B2 | | 12/2003 | MacMillan |
| 6,677,007 | B1 | | 1/2004 | Warner et al. |
| 6,696,118 | B2 | | 2/2004 | Asaoka et al. |
| 6,716,495 | B1 | | 4/2004 | Yoshino et al. |
| 6,726,770 | B2 | | 4/2004 | Eichinger |
| 6,761,943 | B1 | | 7/2004 | Warner et al. |
| 6,777,040 | B2 | | 8/2004 | Tatsuhashi et al. |
| 6,797,347 | B2 | | 9/2004 | Chow |
| 6,821,583 | B2 | | 11/2004 | Shouldice et al. |
| 6,869,639 | B2 | | 3/2005 | Damrau et al. |
| 6,893,473 | B2 | | 5/2005 | Neogi et al. |
| 6,893,682 | B2 | | 5/2005 | Halmschlager et al. |
| 6,896,952 | B2 | | 5/2005 | Calland |
| 7,070,840 | B2 | | 7/2006 | Yamada et al. |

(Continued)

FOREIGN PATENT DOCUMENTS

| | | |
|---|---|---|
| DE | 211819 | 7/1984 |

(Continued)

OTHER PUBLICATIONS

Jim Thurn, History, Chemistry, and Long-Term Effects of Alum-Rosin Size in Paper, Technology & Structure, Dec. 3, 2003, 8 pages, retrieved from the internet Jun. 20, 2007, http://www.ischool.utexas.edu/~cochinea/txt/j-thurn-03-alum.txt.

(Continued)

*Primary Examiner*—Betelhem Shewareged
(74) *Attorney, Agent, or Firm*—Joel T. Charlton

(57) ABSTRACT

In web/ink-jet operations in which ink jet data is over-printed on forms prepared by offset litho, undesirable interactions between the surface size and litho-fountain are controlled by use of a PCC basesheet having a size press coating of starch and alum, the alum amount being at least 0.75% by weight.

48 Claims, 1 Drawing Sheet

U.S. PATENT DOCUMENTS

| | | | | |
|---|---|---|---|---|
| 7,074,495 | B2 | 7/2006 | Tamagawa et al. | |
| 7,086,726 | B2 | 8/2006 | Takashima et al. | |
| 7,090,903 | B2 | 8/2006 | Katoh et al. | |
| 7,141,280 | B2 | 11/2006 | Schulz et al. | |
| 7,172,651 | B2 | 2/2007 | Chen et al. | |
| 7,183,027 | B2 | 2/2007 | Takegawa et al. | |
| 7,195,665 | B2 | 3/2007 | Osumi et al. | |
| 7,199,182 | B2 | 4/2007 | Tanaka et al. | |
| 7,201,791 | B2 | 4/2007 | Okamura et al. | |
| 7,201,793 | B2 | 4/2007 | Iijima et al. | |
| 7,202,005 | B2 | 4/2007 | Tomoyori | |
| 7,214,728 | B2 | 5/2007 | Kimpimaki et al. | |
| 7,217,447 | B2 | 5/2007 | Takashima et al. | |
| 7,235,284 | B1 | 6/2007 | Fryberg et al. | |
| 7,250,202 | B1 | 7/2007 | Steiger | |
| 2002/0061387 | A1 | 5/2002 | Asaoka et al. | |
| 2002/0068154 | A1 | 6/2002 | Misuda et al. | |
| 2002/0136868 | A1 | 9/2002 | Moriya et al. | |
| 2003/0145966 | A1* | 8/2003 | Terpstra et al. | 162/175 |
| 2004/0048007 | A1 | 3/2004 | Katoh et al. | |
| 2004/0091646 | A1 | 5/2004 | Taka et al. | |
| 2004/0096598 | A1 | 5/2004 | Kasamatsu et al. | |
| 2004/0121093 | A1 | 6/2004 | Ogino et al. | |
| 2004/0157009 | A1 | 8/2004 | Ohbayashi et al. | |
| 2004/0161556 | A1 | 8/2004 | Nishijima et al. | |
| 2004/0197498 | A1 | 10/2004 | Bi et al. | |
| 2004/0228985 | A1 | 11/2004 | Calland | |
| 2004/0241349 | A1 | 12/2004 | Schulz et al. | |
| 2005/0089652 | A1 | 4/2005 | Kasahara et al. | |
| 2005/0133182 | A1 | 6/2005 | Park et al. | |
| 2005/0217815 | A1 | 10/2005 | Stoffel et al. | |
| 2005/0248645 | A1 | 11/2005 | Jenkins et al. | |
| 2005/0266180 | A1 | 12/2005 | Bi | |
| 2005/0276936 | A1 | 12/2005 | Bi et al. | |
| 2006/0013971 | A1 | 1/2006 | Chen et al. | |
| 2006/0051528 | A1 | 3/2006 | Ogino et al. | |
| 2006/0093760 | A1 | 5/2006 | Taka et al. | |
| 2006/0115612 | A1 | 6/2006 | Nakata et al. | |
| 2006/0121216 | A1 | 6/2006 | Nishijima | |
| 2006/0165976 | A1 | 7/2006 | Zuraw et al. | |
| 2006/0185808 | A1 | 8/2006 | Nguyen | |
| 2006/0228499 | A1 | 10/2006 | Tran et al. | |
| 2006/0233977 | A1 | 10/2006 | Taka et al. | |
| 2007/0087136 | A1 | 4/2007 | Stoffel et al. | |
| 2007/0087138 | A1 | 4/2007 | Koenig et al. | |
| 2007/0125267 | A1* | 6/2007 | Song et al. | 106/214.1 |
| 2007/0134451 | A1 | 6/2007 | Hakamada et al. | |
| 2007/0172608 | A1 | 7/2007 | Tojo et al. | |
| 2007/0193707 | A1 | 8/2007 | Nguyen | |

FOREIGN PATENT DOCUMENTS

| | | |
|---|---|---|
| EP | 0335575 B1 | 3/1993 |
| EP | 0899373 A1 | 3/1999 |
| EP | 0905317 A1 | 3/1999 |
| GB | 1504128 | 3/1978 |
| KR | P2001-0093892 | 10/2001 |

OTHER PUBLICATIONS

Barbara Wortley, Bonding With Polyaluminum Chloride Makes Neutral Rosin Sizing Possible: North American mills follow European mill lead in using PAC compounds in alkaline conversions; retention and drainage also improved, Pulp & Paper, Nov. 1990, pp. 131-133.

Permanence of Paper for Publications and Documents in Libraries and Archives, ANSI/NISO Z39.48-1992 (R2002), National Information Standards Organization, Oct. 26, 1992, NISO Press, Bethesda, Maryland.

English translation of: DE 211819, published Jul. 25, 1984, VEB WTZ DER Zellstoff. U. Paperindustrie, entitled "Method For Surface Sizing Paper".

English translation of: KR 10-0342366 B1, registered Jun. 17, 2002, published as Publication No. P2001-0093892 on Oct. 31, 2001, Kyesung Paper Co., Ltd., entitled "Method For Manufacturing Base Paper For Instant Noodle Container".

MacDonald, et al., Internal Sizing, Papermaking and Paperboard Making, 1970, pp. 35-78, vol. III., McGraw-Hill Book Company, New York, New York, USA.

Gary A. Smook, Preparation of Papermaking Stock, Handbook for Pulp & Paper Technologists, 1992, pp. 194-208, 2nd Edition, Capter 13, Angus Wilde Publications Inc., Vancouver, British Columbia.

Gullichsen, et al., Chemical Pulping, Papermaking Science and Technology, 1999, pp. A158-A159, Chapter 2, A642-643, Chapter 9, Book 6A, Book 6A, Fapet Oy, Helsinki, Finland.

Bristow, et al., ISO Brightness of Fluorescent Papers and Indoor Whiteness—Proposal for Illuminant, Tappi Journal, January 1999, pp. 183-193, vol. 82, No. 1, Tappi, Norcross, Georgia, USA.

* cited by examiner

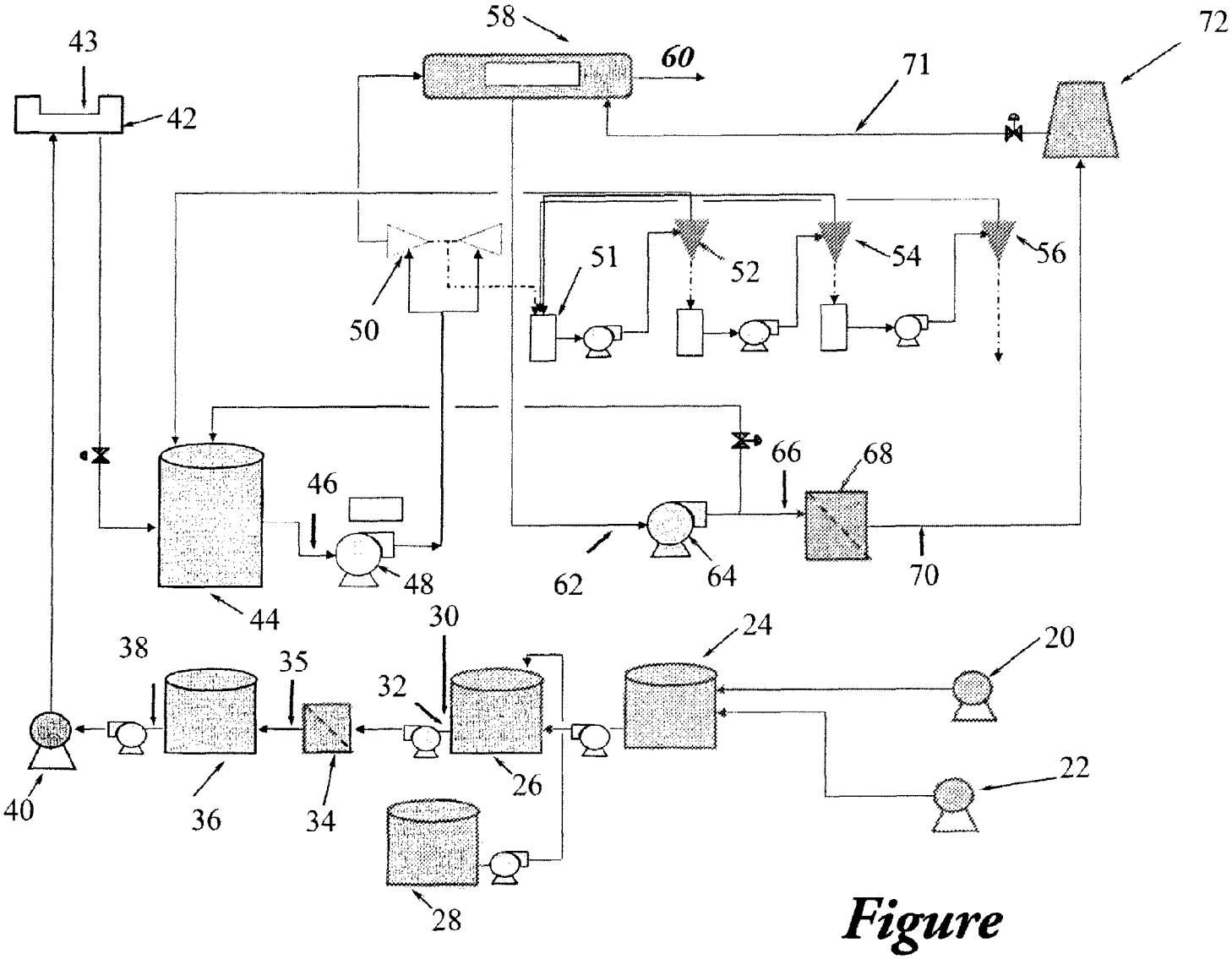
Figure

DUAL MODE INK JET PAPER

This non-provisional application is based upon U.S. Provisional Patent Application Ser. No. 60/949,654, of the same title, filed Jul. 13, 2007. The priority of U.S. Provisional Patent Application Ser. No. 60/949,654 is hereby claimed and the disclosure thereof is incorporated into this application by reference.

Ink jet printers are in many ways ideal for computerized printing of continuously varying output. However, when many identical copies are required, it is typically far more economical to use more conventional methods of printing such as flexography, rotogravure and offset lithography. Thus, in many cases, for mass mailings such as for utility bills, credit card statements, invoices and the like, in which most of the printing on each document will be identical to the printing on several hundred thousand similar documents, it has proved expedient to print most of the form conventionally while applying the individualized portions from a high speed inkjet printer. Sizes, or sizing materials, are commonly applied to papers used for communications purposes to fill pores in the paper surface, controlling and limiting absorption of ink so that the clarity of the printed image is not lost. The cost of size can contribute significantly to the cost of the paper used for such documents. Because these documents are often generated in quantities of hundreds of thousands or millions, there is quite naturally a desire to minimize the cost of the paper utilized therein as even small cost reductions per unit will amount to significant savings.

However, the requirements for inkjet papers are quite distinct from the requirements for papers to be printed on by conventional technology—papers that are optimized for conventional printing are not necessarily well-suited for inkjet printing and vice versa. In particular, ink jet printing papers require bleed resistance for commonly used jet inks. However the external sizes required to provide bleed resistance have been found to interfere with lithographic printing in many cases. Accordingly, there exists a need for an extremely low-cost method of sizing paper which is suitable for both lithographic printing and high-speed inkjet printing on the same document.

In the past, papers for this relatively demanding ink jet printing application have been manufactured using relatively expensive cationic polymer surface sizing agents as jet ink fixatives. However, with the exception of the relatively expensive citrate based surface sizes, the sizes used for inkjet applications presented a variety of serious drawbacks. In some cases, non-thermosetting cationic polymers used as surface sizes would react with anionic species found in the fountain solution for offset lithographic printing and ultimately would gum up the printing plates making it necessary to shut down the press for cleaning. In other cases, thermosetting cationic polymer sizes interfered with re-pulping of sized paper.

In general, two different techniques are utilized for sizing paper: (i) internal sizing in which the size is incorporated into the paper in the wet end of the paper machine; and (ii) external or surface sizing in which starch and other sizing components are applied in a size press after the sheet has been formed. Although there is considerable overlap between sizing agents used for internal and external sizing, in general, the agents used for the two techniques are not identical. In particular, it had been common to use alum (aluminum sulfate) as one component in an internal size in the days when acid papers were very common, the alum most likely not operating as a true size but rather as a fixative to cure the fatty acids in the rosin also included in the internal size. However, as alum is acidic, widespread adoption of alkaline papermaking has led to a tendency to use far more expensive sizing agents as internal sizes. Widely used sizes currently include such materials as alkyl and alkenyl ketene dimers ("AKD"), alkenyl succinic anhydride ("ASA"), rosin, and polysiloxanes in a wide variety of permutations. In many cases, surface sizes have included relatively small proportions of alum along with far larger quantities of far more expensive polymeric materials.

Besides being expensive, as mentioned, some of the cationic polymer surface sizing agents used as fixatives for jet inks have also been found to interfere with the offset lithographic printing process by leaching into the litho fountain solution and "gumming up" the litho printing plates.

This invention is based on the discovery that it is possible to make papers including calcium carbonate which are very suitable for the offset lithography/inkjet printing combination using a very low-cost surface size comprised primarily of starch and of alum applied in quantities of over 15 pounds of alum per ton of paper, preferably 25 to 30 pounds of alum per ton of paper. The resulting paper has excellent jet ink bleed and cockle resistance properties, and the alum has been found to exhibit excellent compatibility with the offset lithographic printing process. Additionally, we have found that sizes comprised of polyaluminum chloride and starch can also be used satisfactorily for this application as can malate based surface sizes, although at greater expense.

PRIOR ART

U.S. Pat. No. 6,162,328, Cenisio, et al., relates to surface sizing of papers with a combination of at least one cellulose reactive size, preferably a ketene dimer or multimer, and at least one cellulose non-reactive size, wherein the non-reactive size is a polymer having a molecular weight of least about 1500, and the cellulose reactive size is not solid at 25° C., mentioning the use of alum as a material commonly added to the aqueous pulp suspension also including wet strength resins, internal sizes, dry strength resins, retention aids, fillers, pigments and dyes.

U.S. Pat. No. 5,562,974, Kuroyama, et al., relates to use of aluminum sulfate (alum) as a component in an internal size which is pH adjusted with a water soluble alkaline salt close to neutral pH (6.5-7.5) to form a paper which is surface sized with an aqueous solution of an alkaline metal salt of an acid having a pKa of 5-14. Sodium hydrocarbonate, sodium carbonate, disodium hydrophospate and sodium phosphate are mentioned as suitable salts.

U.S. Pat. No. 4,551,385, Robbart, relates to coating of cellulosic substrates, particularly newsprint, groundwood paper and clay coated bleached board with reactive siloxane or polysiloxane to form an oleophilic siloxane layer thereupon. In his Background of the Invention, Robbart mentions that:

> 'Heretofore, improvements in sheet characteristics have been achieved through the use of additives or coatings in the manufacture of many printing or packaging grades of paper. Typical additives such as rosin, alum and the like or typical coatings such as those comprised of starch, clay, appropriate binders and brighteners are often employed to assist printability and runnability of the substrate. These techniques are frequently costly and cumbersome and often fall wide of the mark of producing an ideal printing substrate.'

Robbart also teaches that:

> ' . . . the present invention contemplates coating the cellulosic substrate with conventional coating materials to improve smoothness, brightness, gloss, etc. prior to the silane treatment. Such coating materials are well known to those skilled in the art and include, for example, alum, clay, starch, resinous binders, etc.'[emphasis added]

U.S. Pat. No. 4,239,592, Gaspar et al., relates to surface sizing of papers with:

'. . . aqueous dispersions of blends of hydrophobic starch monoesters of specified dicarboxylic acids . . . and non-hydrophobic starches . . . [to provide] . . . paper and paperboard products which display significantly improved size properties. . . . '

Gaspar et al. further teaches that:

'All types of paper dyes and tints, pigments and fillers may be added to the paper (in the usual manner) which is to be sized in accordance with this invention. Such materials include clay, talc, titanium dioxide, calcium carbonate, calcium sulfate, and diatomaceous earths. The paper can contain other additives, including rosin and alum and other internal sizes. Other surface sizing compounds as well as pigments, dyes and lubricants can also be used in conjunction with the size blends described herein.

The hydrophobic/non-hydrophobic starch blends are ordinarily employed in amounts to provide a size concentration ranging from 0.25 to 15.0% of the weight of the finished dry paper. Within this range, the precise amount which is used will depend for the most part upon the type of pulp which is being utilized, the specific operating conditions, as well as the particular end use for which paper is destined.

The use of the starch blends described herein in accordance with the process of this invention has been found (as will be illustrated in the examples) to yield paper having improved size properties, for example, resistance to water or acidic ink solutions. A specified degree of size properties in paper can be achieved with a smaller amount of the described size utilized in accordance with the process of this invention. The presence of alum (papermaker's alum, $Al_2(SO_4)_3.14\text{-}18H_2O$) or other commonly used cationic donor in the size dispersion or in the web being sized appears to enhance the sizing properties achieved with the starch blends of the present invention. Representative cationic donors include, for example, polyamideamine resins chain extended with epichlorohydrin or other chain extender such as described in U.S. Pat. Nos. 2,929,154 and 3,793,279, as well as cationic urea-formaldehyde or melamine-formaldehyde resins.'

GB Patent 1,504,128, Amos, discloses a surface size prepared from:

'(i) a low viscosity . . . grade of sodium carboxymethyl cellulose;

or (ii) modified . . . or unmodified starch;

(iii) alum;

and (iv) a carboxylic acid group-containing compound consisting of rosin, maleinised rosin, an alkali metal soap . . . or maleinised petroleum resin;

in the proportions of 0.8 to 2.0 of (i) or 1.0 to 4.0 of (ii)), 0.08 to 0.12 of (iii) and 0.8 [sic] to 0.12 of (iv) by weight, the total concentration of these components in the solution being from 10.0 to 1.0% by weight.'

Significantly, Amos teaches that:

'The ratio of the three components of the sizing composition is critical, and it is preferred that the proportion of components (i) or (ii), (iii) and (iv) respectively is 1.0: 0.1:0.1 by weight.

Although amounts of alum above the upper limit of 0.12 relative to the other two components can be tolerated in some cases, the increased acidity and lower colloidal stability of the resulting composition makes such usage undesirable.'

Amos suggests using the surface size in amounts of at least 0.3 g/m$^2$ (0.184 lbs/3000 sq .ft. ream.). Amos reports various surface sizing trials on bleached sulfite pulp paper in amounts ranging from 0.15 to 1.1 g/m$^2$ with a variety of sizes containing less than 10% alum.

GDR Patent 211,819, Ullmann, discloses an external starch/resin size for paper which is acidified with alum or sulfuric acid.

U.S. Pat. No. 5,180,624, Kojima et al., relates to an internally sized ink jet recording paper bearing a pulp containing ink-receptive layer comprising an ink-penetration preventive agent such as:

'. . . surface sizing agents, hydrophobic agents . . . , low hydrophilic agents and the coating agents thereof [sic]. The surface sizing agents include, for example, acid sizing agents such as fortified rosin size, petroleum resin size, emulsion-type rosin size, alkenyl succinic acid neutral paper manufacturing [sic], such as alkenylketene dimer, alkyl succinic anhydride; cationic resin sizing agent; anionic or cationic acrylamides; and the like.

Among the retention aids to be used in this invention are vegetable gum, cationic starches, potato starches, sodium aluminate, colloidal animal glue, acrylamide resin, aluminum sulfate, styrene-acrylic resin, polyethylene-imine, modified polyethylene-imine, polyethylene-imine quaternary salt, carboxylated polyacrylamide partially aminated polyacrylamide, acid addition compounds of partially aminomethylated polyacrylamide, acid addition compounds of partially methylolated polyacrylamide, epichlorohydrin resin, polyamide epichlorohydrin resin, formalin resin, modified polyacrylamide resin and the like.'

Kojima et al. present several examples in which small amounts of aluminum sulfate are used in the base layer and/or the ink-receptive layer.

U.S. Pat. No. 4,522,686, Dumas, relates to size compositions comprising both fortified rosin and cellulose-reactive sizes. Dumas states that:

'. . . alum in any amount can be present in the aqueous cationic dispersions of this invention without destroying size efficiency and that the presence of alum provides an outstanding advantage in convenience which was not realizable heretofore. In general, when alum is present, the amount will range from about 25 to about 200% based on the weight of fortified rosin particles. The most practical range, however, is 75 to 150% and this is the preferred range . . . '

Dumas presents examples in which blends of cellulose reactive sizes (AKD) with fortified rosin and either 9.56% or 13.9% alum were used as external size for un-sized bleached kraft paper having a basis weight of 40 pounds per 3000 square-foot ream at levels of a fraction of a percent by weight of the fiber.

Korean Patent 10-0342366, Eunsu et al., relates to a method of manufacturing a base paper for an instant noodle container having a synthetic resin film laminated on the base paper. Eunsu et al. base papers have a basis weight of 200 to 400 g/m$^2$ (121-242 lbs/3000 sq. ft. ream) and are both surface and internally sized. A fixing agent selected from alum and polyaluminum chloride is present in the internal size in the amount of 0.2 to 8% based on the dry weight of the fiber while a cationic agent selected from quaternary ammonium chloride, calcium stearate, alum, and polyaluminum chloride is present in amount of 0.01 to 3 weight percent.

SUMMARY OF THE INVENTION

Applicants have discovered that it is possible to make alkaline papers which are very suitable for the offset lithography/inkjet printing combination using a very low-cost surface size comprised primarily of starch and of alum applied in quantities of over 15 pounds of alum per ton of paper, preferably 20 to 30 pounds of alum per ton of paper. The resulting paper has excellent jet ink bleed and cockle resistance properties, and the alum has not been found to interfere with the offset lithographic printing process. Further, the paper is easily re-pulped facilitating recycling of broke and/or spoiled materials.

BRIEF DESCRIPTION OF THE FIGURE

The FIGURE is a schematic flow diagram of the process by which the furnish used for the basesheet used in the present invention is prepared.

DESCRIPTION OF THE PREFERRED EMBODIMENT

Communications papers of the present invention comprise a basesheet with a caliper of between 3 and 7 mils comprising precipitated calcium carbonate ("PCC") and cationic starch dispersed in a dense cellulosic matrix, the basis weight of the basesheet being between 15 and 35 pounds per 1300 square-foot ream. Typically the PCC is present in amount between 10 and 25 percent by weight of the basesheet. The ratio of PCC to cationic starch ranges from about 2:1 to 1:20. On a dry weight basis, the amount of cationic starch to pulp can vary from about 0.5% to about 1.5% based on the dry weight of pulp. The preferred range is from about 1.0% to about 1.5%. In operation, PCC is added in the wet end often in the form of calcite, typically formed by bubbling carbon dioxide through "milk of lime", a suspension of $Ca(OH)_2$, in water to form $CaCO_3$. Retention aids, sizing agents such as AKD and ASA, cationic coagulants, anionic flocculants and optical brightening agents, are often included to form a cellulosic suspension having a pH in the range of from only slightly less than about 7 to about 9.0.

U.S. Pat. No. 4,892,590, Gill et al., discusses addition of PCC, filler, and cationic potato starch to a hardwood-softwood furnish to form a communications paper. European Patent No. 0335575, Langley, discussed other techniques for incorporating PCC into papers which are suitable for basesheets of the present invention.

One basesheet which is suitable as a substrate to which low-cost surface size comprised primarily of starch and of alum may be prepared as illustrated in the FIGURE, hardwood pulp passing through hardwood refiner 20 and softwood pulp passing through softwood refiner 22 are blended in stock mix tank 24 and thereafter blended with broke from broke chest 28 in blend chest 26. Precipitated calcium carbonate (PCC), typically in amounts of about 160 pounds per ton, and optical brightener if desired, typically in amount of about 18 pounds per ton, are added through ports 30 and 32 respectively to thick stock as it passes to thick stock screens 34 with cationic starch being added at 35 between thick stock screens 34 and machine chest 36 in an amount of approximately 5 pounds per ton. Additional precipitated calcium carbonate in the amount of about 200 pounds per ton is added at 38 exiting machine chest 36 prior to entering tickler refiner 40. Tinting dye is added to stuff box 42 at 43 prior to passage to silo 44. If desired, polyaluminum chloride may be added through 46 to the inlet to cleaners pump 48 in an amount of about 2.1 pounds per ton. Accepts from primary centrifugal cleaners 50 as well as thinstock in recirculation line 71 from headbox 72 are passed through cleanvac 58 for de-aeration wherein entrained air is removed and discharged through line 60. At 62, thinstock from silo 44 is blended with alkenyl succinic anhydride (if desired) and starch in the amounts of 1.4 pounds per ton and 2.1 pounds per ton respectively at the inlet to fan pump 64 with retention aid in the amount of about 1.2 pounds per ton being added at 66 between fan pump 64 and screens 68 with an additional pound per ton of retention aid being added at 70 after screens 68 and prior to headbox 72.

Rejects from primary centrifugal cleaners 50 are passed to secondary cleaner mix tank 51 where they are mixed with accepts from both tertiary cleaner 54 and quaternary cleaner 56. Accepts from secondary cleaner 52 are passed to silo 44 and recycled through primary centrifugal cleaners 50.

Basesheets of the present invention will have at least one surface bearing a size press coating consisting essentially of starch and alum, the amount of alum being at least 0.75% by weight of the cellulosic matrix. The size press coating may be applied either from a conventional size press or a metered size press. Suitable presses are disclosed in U.S. Pat. No. 6,893,682, Halmschlager et al., Method and Device for Single-or Double-Sided Application, May 17, 2005; U.S. Pat. No. 6,869,639, Damrau et al., Film Coater and Smoothing Method and Apparatus, Mar. 22, 2005; U.S. Pat. No. 6,726,770, Eichinger, Applicator Device, Apr. 27, 2004; U.S. Pat. No. 6,316,060, Elvidge, et al., Metering Coatings, Nov. 13, 2001; U.S. Pat. No. 6,261,368, Wight, Short Dwell Coater with Cross Machine Direction Profiling, Jul. 17, 2001; U.S. Pat. No. 6,106,902, Koskinen, et al., Method and Apparatus for Coating a Moving Paper or Cardboard Web, Aug. 22, 2000; U.S. Pat. No. 5,904,775, Salo, et al. Method and Device for Applying a Coating Agent onto a Moving Base, May 18, 1999; and U.S. Pat. No. 5,895,542, Wadzinski, Coater and a Method for Coating a Substrate, Apr. 20, 1999.

While alum is preferred in external sizes of the present invention, also effective are polyaluminum chlorides ("PACs") having the composition $Al_n(OH)_mCl_{(3n-m)}$ where the ratio of m/n is from about 0.5 to about 2.5. Typically, PACs are sold diluted in water. Through this specification and claims, where the weight or weight percentage of a PAC is mentioned, it should be understood that the weight or percentage meant is that of the PAC on an anhydrous basis, i.e., excluding water. For this application, we prefer to use the Ciba PAC, sold under the trademark PHACSIZE and having the approximate composition $Al_2(OH)_{2.56}Cl_{3.44}$. This PAC was found to achieve equal ink bleed resistance to $Al_2(SO_4)_3$ at a given add-on level. Further, monosodium malate and mixtures of monosodium malate and malic acid are also effective but at higher cost.

The process of the invention is especially suitable for use with offset printing processes in which the fountain solution can be contaminated by the external sizes conventionally used to make the sheet compatible with anionic jet inks. As further described in the Examples hereto, we have found that many external sizes conventionally used for ink jet papers interact detrimentally with the fountain of an offset lithographic press resulting in a scum being deposited on the plates after several thousand impressions have been run. As the combination of offset lithographic and high speed ink jet printing is best suited for documents produced in large numbers having personalized materials superimposed over one background appearance common to all, this can significantly increase the cost of the print run. Web ink jet papers externally sized with the aluminum size active compounds of the present invention will run tens of thousands of impressions without forming an undesirable scum on the offset plates which would interfere with the print run.

Size compositions of the present invention having the following composition are especially suited for use in mass production of offset litho/high speed ink jet products such as those used for personalized mass mailings such as bills and the like:

1) from about 5 to about 75% of a size active compound chosen from the group consisting of alum, polyaluminum chloride, monosodium malate and mixtures of monosodium malate and malic acid;
2) optionally, up to about 15% starch;
3) optionally, an optical brightener;
4) optionally, a defoamer, such as silicone or oil based defoamer;
5) optionally up to about 30% of a filler or pigment such as kaolin, titanium dioxide or the like;
6) optionally up to about 20% of a filler such as ground calcium carbonate if the size active compound is chosen from the group consisting of monosodium malate and mixtures of monosodium malate and malic acid; and
7) balance, water.

The preferred external sizing compositions of the invention may contain other conventional sizing components, and in particular, conventional sizing binder. Thus, although the sizing dispersion of the invention is generally made in the presence of little or no surfactant, binder such as starch or other suitable polymer can be included. The starch may be gelatinised and may be unmodified or modified, for instance cationic starch. The dry weight of starch to size active compound is generally in the range 5:1 to 40:1, i.e., corresponding to the general proportions of starch and size conventionally applied when sizing at the size press. The optimum amount will depend upon other conditions, for instance the extent (if any) to which the sheet is already internally sized. The amount of starch or other binder which is applied in the external sizing coating is usually in the range 0 to 40 g/m$^2$ with the amount of alum being at least about 0.75%, more preferably at least about 1%, still more preferably at least about 1.25%, and most preferably at least about 1.5% of the weight of the basesheet. The starches which can be used in the present invention may be derived from any plant source including corn, potato, sweet potato, wheat, rice, sago, tapioca, waxy maize, sorghum, high amylose corn, or the like. Additionally, conversion products derived from any of these bases can be employed, including, for example, dextrins prepared by the hydrolytic action of acid and/or heat; oxidized starches prepared by treatment with oxidants such as sodium hypochlorite; and fluidity or thin boiling starches prepared, for example, by enzyme conversion or mild acid hydrolysis. If the desired starch blend is to be a granular starch then obviously the initial starting material must be in granular form.

Defoamers are well known. Exemplary commercially-available products (some or all of which may be considered to have proprietary formulations) which can be used as defoamer compositions in the present invention if desired include but are not limited to the following materials: (A) an oil-based product sold by Henkel KGaA of Germany under the product designation/trademark: "Foammaster VFS"; and (B) an oil-based product sold by Cognis Corporation of Cincinnati, Ohio (USA) under the product designation/trademark "Foamstar® A12". An example of a silicone-based anti-foam is a silicone oil that is a polydiorganosiloxane combined with hydrophobic silica as disclosed in U.S. Pat. No. 4,012,334 (General Electric Co.). The anti-foam active ingredient preferably includes one or more of a polydiorganosiloxane fluid, a silicone resin, a high molecular weight silicone gum, and precipitated silica or fumed silica or a combination thereof. Other components, for example, surfactants, glycerol, petroleum waxes, paraffin waxes, synthetic waxes, may be added to form the anti-foam active ingredient.

Preferred polydiorganosiloxane fluids are those having the repeating structure:

$$—(R_2SiO)_x—$$

wherein each R is independently alkyl or aryl, preferably ($C_1$-$C_{40}$)alkyl, more preferably, methyl, and x is an integer of at least 10, preferably at least 20. Preferred polydiorganosiloxanes are polydimethylsiloxanes. Polydisiloxanes are well known in the art and are commercially available. Preferred silicone resins are methylpolysiloxane resins, which are well known in the art and are commercially available.

Useful high molecular weight silicone gums are polydiorganosiloxanes, especially polydialkylsiloxanes and polyalkylarylsiloxanes. The high molecular weight silicone gums generally have a number average molecular weight (Mn) in excess of 140,000 and typically in the range of 140,000 to 350,000. Alternatively, the weight average molecular weight (Mw) is in excess of 200,000 and is typically in the range of 200,000 to about 1,000,000. Specific examples of useful high molecular weight silicone gums include poly(dimethylsiloxane), (dimethylsiloxane)(methylvinylsiloxane) copolymer, poly(phenylmethylsiloxane), alpha,omega-bis(hydroxy)poly(dimethylsiloxane), (dimethylsiloxane)(diphenylsiloxane)(methylvinylsiloxane) copolymer and mixtures thereof.

As used herein, "($C_2$-$C_{40}$)alkenyl" means a straight or branched chain alkenyl group containing from 2 to 40 carbon atoms per group and at least one double bond between two carbon atoms per group, such as, for example, vinyl, propenyl and butenyl.

As used herein, the term "aryl" means a monovalent unsaturated hydrocarbon ring system containing one or more aromatic rings per group, which may optionally be substituted on the one or more aromatic rings, preferably with one or more ($C_1$-$C_{40}$)alkyl groups and which, in the case of two or more rings, may be fused rings, including, for example, phenyl, 2,4,6-trimethylphenyl, 2-isopropylmethylphenyl, 1-pentalenyl, naphthyl, and anthryl.

Surfactants that may be used in the anti-foam ingredient include silicone-based surfactants, as well as inorganic-based or organic-based surfactants, such as, for example, anionic, nonionic, cationic Zwitterionic and amphoteric surfactant compounds and mixtures thereof. Preferred surfactants are anionic and nonionic surfactant compounds. Examples of anionic surfactants include alkali metal salts of organic sulfates and sulphonites, such as sodium and potassium alkyl sulfates; phosphate esters; and sucrose esters. Examples of nonionic surfactants include the reaction products of alkylene oxides (usually ethylene oxide) with alkyl phenols, the condensation products of aliphatic alcohols with ethylene oxide, products made by condensation of ethylene oxide with the reaction products of propylene oxide and ethylenediamine, long-chain tertiary amine oxides, long-chain tertiary phosphine oxides and dialkyl sulphoxides. Examples of suitable cationic surfactants include alkylamine salts, quaternary ammonium salts, sulphonium salts, imidazoline compounds and phosphonium salts. Examples of amphoteric surfactants include alkylaminoacid salts and betaines. Suitable surfactants are known in the art and are commercially available.

When optical brighteners are desired, some care must be taken in selection of the addition point for the brightener; as many commercially available brighteners are counter-effective if incorporated into the size press composition, precipitating out due to an undesirable interaction with the aluminum or malate/malic acid containing size active compositions. In those cases, it is usually preferred to incorporate the optical brightener into the paper in the wet end as described in conjunction with the explanation of the FIGURE above.

Our experience leads us to believe that these alum based external size compositions have far less tendency to interact with fountain solution and desensitize the off set plate than do cationic surface sizes as known to the prior art. When binder, viscosifier or other additives are to be included, they are usually mixed into the sizing dispersion of the invention after it has been made in the substantial absence of additives, as described above.

EXAMPLES

Comparative Example 1

Control—Hercules 5018

A prior art external size comprising Hercules 5018 cationic polymer solution was metered into the size press starch run tank of a commercial paper machine to produce 20# bond, affording 20-22 lb/ton dry polymer pickup. Jet ink bleed resistance was acceptable per the water dip test. The water dip test is conducted by dipping an 8½×11 inch paper sample, printed with a test image by ink jet, into deionized room temperature water for one minute and then removing the paper from the water and allowing to drip dry. Significant ink transfer to non-image areas and/or loss of image resolution indicate unacceptable jet-ink bleed.

When this paper was printed on a Mueller/Martini web-to-sheet UV offset lithographic press, plate and blanket contamination leading to print degradation became visible after about 25,000-30,000 impressions. Material analysis indicated that the cationic polymer was most likely transferring from the paper up into the fountain solution and inking system. At least two alternate litho fountain solution chemistries were evaluated, but to no benefit. In one case, plate/blanket contamination occurred within 3000 impressions. Accordingly, it was concluded that this size composition was not well suited for this particularly demanding application.

Example 2

Alum

Solutions of Alum in water were prepared at 1%, 2%, 3%, and 5%. Each solution was applied to an unsized Web Ink Jet base sheet ("WIJ Blank") with a #3 Meyer rod. After drying, each sample was measured analytically for alum content and tested for bleed resistance per the water dip test. At 13 lb/ton (2% solution) or less, bleed resistance was inadequate, but at 17 lb/ton (3% solution) or greater, jet ink bleed resistance was satisfactory.

Bond paper basesheets having a basis weight of approximately 20 pounds per 1300 square-foot ream were prepared for Examples 3, 7, and 9 on a pilot paper machine operating at 78 fpm. Base sheet fiber ratio was 60% northern softwood/40% northern hardwood, refined to ~500 CSF. Furnish included 15% Albacar LO precipitated calcium carbonate filler, 0.5 lb/ton AKD internal size, and 15 dry lb/ton cationic starch (thick stock addition). A conventional size press was utilized. In each case, the size press formula was prepared in a conventional manner by cooking the starch in some of the water, and then adding the other listed components. As demonstrated hereinafter, the breakpoint between generally inadequate bleed resistance and satisfactory bleed resistance was at about 15 lb/ton (0.75 wt %).

Example 3

Alum

A size press formulation was prepared by combining the material set forth in Table 1:

TABLE 1

| | |
|---|---|
| 1453 g | Penford 280 dry starch |
| 109 g | NaCl |
| 363 g | Optiblanc XLN optical brightener (3V Corporation) |
| 708 g | Alum as the - 18 $H_2O$ hydrate |
| 11,895 g | Water |
| 14,528 g | Batch total (32 lb) |

A second size press formulation was prepared similarly, but with Optiblanc XLN replaced with water in the size press, and Optiblanc NF-200 injected at 20 lb/ton into the furnish as thick stock.

Bleed resistance of both rolls was acceptable per the water dip test. Offset lithographic printing of both rolls was evaluated with a 2+2 print form on a Mueller/Martini roll-to-sheet UV press running 300-400 fpm. Prisco H8P fountain solution was used. A total of 4000 impressions was printed with no sign of toning or plate/blanket contamination.

Example 4

Alum

Alum solution was metered into the size press starch run tank of a commercial paper machine to produce 20# bond with alum at 16 lb/ton. Jet ink bleed resistance was acceptable per the water dip test. Four rolls (94,000 impressions) were offset printed on a Mueller/Martini press with no sign of toning or "scumming", or plate/blanket contamination. This excellent performance is considered to constitute a significant advance as the size press formulation is far less expensive than the citrate containing formulations currently used for this application.

Example 5

Alum

Alum solution was metered into the size press starch run tank of a second commercial paper machine to produce 20# bond with alum at 20 lb/ton. Jet ink bleed resistance was acceptable per the water dip test. Four rolls (94,000 impressions) were again offset printed on a Mueller/Martini press with no sign of print quality degradation.

Example 6

PAC

Solutions of poly aluminum chloride in water were prepared at 1%, 3%, 5%, 10%, and 20% based on anhydrous $Al_2Cl_{3.44}(OH)_{2.56}$. Each solution was applied to an unsized base sheet with a #3 Meyer rod. After drying, the samples were bleed tested by the water dip method, and all but the 1% sample were analyzed for PAC content. At 17 lb/ton (3% solution composition), bleed resistance was satisfactory, and above that it was good. In the 1% sample (estimated at 6 lb/ton) bleed resistance was bad.

Example 7

PAC

A size press formulation was prepared by combining the material set forth in Table 2:

TABLE 2

| | |
|---|---|
| 1453 g | Penford 280 dry starch |
| 109 g | NaCl |
| 631 g | Ciba PHACSIZE (57.5% poly aluminum chloride) |
| 12,063 g | Water |
| 272 g | Clariant Leucophor FTS optical brightener |
| 14,528 g | Batch total (32 lb) |

A communications paper sample (#8, see Table 4) was prepared on a pilot paper machine as disclosed above.

Another sample (#10, see Table 4) was prepared similarly, but with 363 g of Optiblanc XLN replacing the Leucophor FTS and 91 g of water. Water dip bleed resistance was good for sample #8 (21 lb/ton) and acceptable for sample #10 (32 lb/ton).

Example 8

Malate

Solutions of Na Malate in water were prepared at 5%, 10%, and 15%. Solutions of Malate Blend (50% Na Malate+50% Malic Acid) were prepared at 6% and 11%. Each solution was applied to an unsized base sheet with a #3 Meyer rod.

At 36 lb/ton Na Malate (5% solution), bleed resistance was poor, but at 72 lb/ton (10% solution), bleed resistance was acceptable, and at 120 lb/ton (15% solution) bleed resistance was good. The malate blend was more effective, for at only 6%, bleed resistance was acceptable, and at 11%, bleed resistance was good.

Example 9

Malate

A size press formulation was prepared by combining the material set forth in Table 3 and two sample rolls of paper were prepared on a pilot paper machine.

TABLE 3

| | |
|---|---|
| 1453 g | Penford 280 dry starch |
| 109 g | NaCl |
| 5984 g | Malate Blend at 15.17% in water |
| 272 g | Optiblanc NF-200 optical brightener (3V Corporation) |
| 6710 g | Water |
| 14,528 g | Batch total (32 lb) |

A third roll was prepared similarly, but with 363 g of 3V Optiblanc XLN replacing the Optiblanc NF-200 and 91 g water in the size press.

Bleed resistance of all three rolls was good per the water dip test. Offset lithographic printing of the three rolls was evaluated with a 2+2 print form on a Mueller/Martini roll-to-sheet UV press running 300-400 fpm. Prisco H8P fountain solution was used. A total of 5000 impressions was printed with no sign of toning or plate/blanket contamination.

Table 4 summarizes the results of evaluations of the foregoing samples based upon dipping the samples into water to obtain an indication of the suitability for use with aqueous based ink jets:

TABLE 4

| Sample Code | Additive Level (lb/Ton) | % Waterfast (High is Better) 100 | % Bleed (Low is Better) 10 | Visible Ink Bleed into Water Severe-Moderate Slight-Trace-None | Print Bleed Appearance Bad, Marginal Acceptable, Good |
|---|---|---|---|---|---|
| Targets | | | | | |
| Pilot PM #1 Blank, 10% Starch | | 93 | 46 | Severe | Bad |
| Pilot PM #2 Hercules 5018 Control | Target 20 | 104 | 1 | Trace | Good |
| Alum Examples | | | | | |
| WIJ Blank | | 86 | 33 | Severe | Bad |
| 10% Al2(SO4)3 | | 106 | 1 | Trace white | Good |
| WIJ Blank | | 88 | 38 | Severe | Bad |
| 5% Al2(SO4)3 | | 100 | 2 | None | Good |
| 10% Al2(SO4)3 | | 104 | 1 | None | Good |
| 15% Al2(SO4)3 | | | | Not Tested | |
| 20% Al2(SO4)3 | | | | Not Tested | |
| WIJ Blank | | 86 | 33 | Severe | Bad |
| 1% Al2(SO4)3 | 5 | 100 | 36 | Severe | Bad |
| 2% Al2(SO4)3 | 13 | 99 | 26 | Moderate | Marginal |
| 3% Al2(SO4)3 | 17 | 99 | 7 | Slight | Acceptable |
| 5% Al2(SO4)3 | 24 | 101 | 7 | Trace | Good |
| #6B Start, Alum + XLN | 37 | 103 | 16 | Slight | Acceptable |
| #6B End, Alum + XLN | 35 | 104 | 14 | Slight | Acceptable |
| #13 Start, Alum | 28 | 98 | 20 | Slight-Moderate | Acceptable |
| #13 End, Alum | 33 | 102 | 10 | Trace | Good |
| WIJ Blank | 0 | 92 | 33 | Severe | Bad |
| Alum Sized A | 16 | 105 | 13 | Slight | Acceptable |
| Alum Sized B | 16 | 103 | 17 | Slight | Acceptable |

TABLE 4-continued

| Sample Code | Additive Level (lb/Ton) | % Waterfast (High is Better) 100 | % Bleed (Low is Better) 10 | Visible Ink Bleed into Water Severe-Moderate Slight-Trace-None | Print Bleed Appearance Bad, Marginal Acceptable, Good |
|---|---|---|---|---|---|
| Control Reel GPLT7E2306 | | 90 | 32 | Severe | Bad |
| Cond A Reel GPLT7E2308 | 14 | 92 | 29 | Moderate | Marginal |
| Trial A Reel GPLT7E2309 | 20 | 97 | 18 | Slight | Acceptable |
| Poly Aluminum Chloride (PAC) Examples | | | | | |
| WIJ Blank | | 86 | 31 | Severe | Bad |
| 1% PAC | | 100 | 44 | Severe | Bad |
| 3% PAC | 17 | 103 | 21 | Slight | Acceptable |
| 5% PAC | 22 | 100 | 2 | None | Good |
| 10% PAC | 44 | 103 | "0" | None | Good |
| 20% PAC | 112 | 98 | 1 | None | Good |
| #8 PAC + Lucophor FTS | 21 | 104 | 5 | Slight | Good |
| #10 PAC + XLN | 32 | 104 | 16 | Slight | Acceptable |
| Malate & Other Examples | | | | | |
| WIJ Blank | | 84 | 34 | | Bad |
| 7% Na Citrate | 26 | 100 | 44 | | Bad |
| 10% Na Citrate | 52 | 90 | 48 | | Bad |
| 14% Na Citrate | 60 | 89 | 46 | | Marginal |
| 17% Na Citrate | 68 | 93 | 22 | | Acceptable |
| 10% Na3 Citrate | | 84 | 34 | | Bad |
| 10% Malate Blend | | 97 | 3 | None | Good |
| 5% Na Malate | 36 | 97 | 36 | Moderate | Bad |
| 10% Na Malate | 72 | 98 | 18 | Slight | Acceptable |
| 15% Na Malate | 120 | 96 | 5 | Trace | Good |
| 6% Malate Blend | | 101 | 14 | Trace | Acceptable |
| 11% Malate Blend | | 96 | 2 | None | Good |
| 20% Na2 Malate | | 95 | 36 | Severe | Bad |
| 20% Na3 Citrate | | 92 | 40 | Severe | Bad |
| 20% NaH2PO4 | | 93 | 20 | Slight | Acceptable |
| 20% (NH4)2HPO4 | | 97 | 7 | Trace | Good |
| 3B Start, Malate Blend | 61 | 105 | 4 | Trace | Good |
| 3B End, Malate Blend | 76 | 105 | 4 | Trace | Good |
| 3C End, Malate Blend | 80 | 105 | 3 | Trace | Good |
| 5B Start, Malate Blend | 72 | 105 | 5 | Trace | Good |
| 5B End, Malate Blend | 86 | 105 | 4 | Trace | Good |

Example 10

20 pound bond substrate with various surface starch additive formulations was prepared by application from a conventional size press on a pilot paper machine. The basesheet was comprised of roughly 60% NSWK/40% NHWK; 15% precipitated calcium carbonate filler; 0.5 #/ton "Precis" AKD internal size; and 15 dry #/ton cationic starch.

| | | |
|---|---|---|
| | Condition 1 "blank" 10% starch | |
| 8181 g | starch & NaCl | 1453 g dry starch, 80#/ton +109 g NaCl, 6#/ton |
| 272 g | Optiblanc NF-200 | 15#/ton |
| 6075 g | water | |
| 14,528 g | (32 lb) | |
| | Condition 2 Hercules control | |
| 8181 g | starch & NaCl | 1453 g dry starch, 80#/ton +109 g NaCl, 6#/ton |
| 272 g | Optiblanc NF-200 | 15#/ton |
| 1211 g | 30% Hercules 5018 | 363 g dry, 20#/ton |
| 4864 g | water | |
| 14,528 g | (32 lb) | |
| | Condition 3 Malate (NF-200 first) | |
| 8181 g | starch & NaCl | 1453 g dry starch, 80#/ton +109 g NaCl, 6#/ton |
| 272 g | Optiblanc NF-200 | 15#/ton |
| 5894 g | malate blend | 908 g dry, 50#/ton |
| 91 g | water | |
| 14,528 g | (32 lb) | |
| | Condition 4 Malate (NF-200 last) | |
| 8181 g | starch & NaCl | 1453 g dry starch, 80#/ton +109 g NaCl, 6#/ton |

-continued

| | | |
|---|---|---|
| 5894 g | malate blend | 908 g dry, 50#/ton |
| 272 g | Optiblanc NF-200 | 15#/ton |
| 91 g | water | |
| 14,528 g | (32 lb) | |

Condition 5 Malate (XLN last)

| | | |
|---|---|---|
| 8181 g | starch & NaCl | 1453 g dry starch, 80#/ton +109 g NaCl, 6#/ton |
| 363 g | Optiblanc XLN | 20 #/ton |
| 5894 g | malate blend | 908 g dry, 50#/ton |
| 14,528 g | (32 lb | |

| | | |
|---|---|---|
| Condition 6 Alum (XLN) | | alum is a hydrate of 51.3% $Al_2(SO_4)_3$ |
| 8181 g | starch & NaCl | 1453 g dry starch, 80#/ton +109 g NaCl, 6#/ton |
| 363 g | Optiblanc XLN | 20 #/ton |
| 708 g | Alum | 363 g $Al_2(SO_4)_3$, 20#/ton |
| 5276 g | Water | |
| 14,528 g | (32 lb) | |

Condition 7 Clariant NTC

| | | |
|---|---|---|
| 8181 g | starch & NaCl | 1453 g dry starch, 80#/ton +109 g NaCl, 6#/ton |
| 272 g | Optiblanc NF-200 | 15#/ton |
| 1135 g | 40% Clariant NTC | 454 g dry, 25 #/ton |
| 4940 g | water | |
| 14,528 g | (32 lb) | |

Condition 8 polyaluminum chloride, LeucophorFTS last

| | | |
|---|---|---|
| 8181 g | starch & NaCl | 1453 g dry starch, 80#/ton +109 g NaCl, 6#/ton |
| 631 g | CIBA PHASIZE | 363 g, 20#/ton |
| 5444 g | water | |
| 272 g | LeucophorFTS | 15#/ton |
| 14,528 g | (32 lb) | |

Condition 9 Na Malate (NF-200 first)

| | | |
|---|---|---|
| 8181 g | starch & NaCl | 1453 g dry starch, 80#/ton +109 g NaCl, 6#/ton |
| 272 g | Letter Optiblanc NF-200 | 15#/ton |
| 6043 g | Na malate blend | |
| 32 g | water | |
| 14,528 g | (32 lb) | |

As our invention, we claim:

1. A sheet of communications paper comprising:

a) a basesheet having precipitated calcium carbonate dispersed in a cellulosic matrix, the basis weight of the basesheet being between 15 and 35 pounds per 1300 square-foot ream, said precipitated calcium carbonate being present in amount between 10 and 25 percent by weight of said basesheet, the caliper of said base sheet being between 3 and 7 mils;

b) said basesheet having applied thereto on at least one surface a size press coating consisting essentially of starch and alum, the amount of alum being at least 0.75% by weight of the cellulosic matrix.

2. The sheet of communications paper of claim 1, wherein the amount of starch present in said size press coating is at least 3% by weight of said cellulosic matrix.

3. The sheet of communications paper of claim 2, wherein the amount of alum present in said size press coating is at least 1% by weight of said cellulosic matrix.

4. The sheet of communications paper of claim 2, bearing indicia thereupon applied by lithographic printing.

5. The sheet of communications paper of claim 4, bearing printed indicia applied thereupon by offset lithographic printing.

6. The sheet of communications paper of claim 5, bearing printed indicia applied thereupon by inkjet printing.

7. The sheet of communications paper of claim 6, wherein said printed indicia applied thereupon by inkjet printing were applied with an anionic ink.

8. The sheet of communications paper of claim 2, wherein the amount of alum present in said size press coating is between 0.75 and 2.0% by weight of said cellulosic matrix.

9. The sheet of communications paper of claim 8, bearing indicia thereupon applied by a printing method using lithographic printing.

10. The sheet of communications paper of claim 9, bearing printed indicia applied thereupon by offset lithographic printing.

11. The sheet of communications paper of claim 10, bearing printed indicia applied thereupon by inkjet printing.

12. The sheet of communications paper of claim 11, wherein said printed indicia applied thereupon by inkjet printing were applied with an anionic ink.

13. A sheet of communications paper comprising:

a) a basesheet having a cellulosic matrix prepared from a non-acidic furnish, the basis weight of the basesheet being between 15 and 35 pounds per 1300 square-foot ream, precipitated calcium carbonate being present in amount between 10 and 25 percent by weight of said basesheet, the caliper of said basesheet being between 3 and 7 mils per sheet;

b) said basesheet having applied thereto on at least one surface a size press coating consisting essentially of starch and an aluminum compound chosen from the group consisting of; (i) alum; and (ii) poiy aluminum chloride, the amount of aluminum compound being at least 0.75% by weight of the cellulosic matrix.

14. The sheet of communications paper of claim 13, wherein the amount of starch present in said size press coating is at least 1.0% by weight of said cellulosic matrix.

15. The sheet of communications paper of claim 14, wherein the amount of aluminum compound present in said size press coating is at least 1% by weight of said cellulosic matrix.

16. The sheet of communications paper of claim 14, bearing indicia thereupon applied by lithographic printing.

17. The sheet of communications paper of claim 16, bearing printed indicia applied thereupon by offset lithographic printing.

18. The sheet of communications paper of 17, bearing printed indicia applied thereupon by inkjet printing.

19. The sheet of communications paper of claim 18, wherein said printed indicia applied thereupon by inkjet printing were applied with an anionic ink.

20. The sheet of communications paper of claim 14, wherein the amount of aluminum compound present in said size press coating is between 0.75 and 2.0% by weight of said cellulosic matrix.

21. The sheet of communications paper of claim 20, bearing indicia thereupon applied by lithographic printing.

22. The sheet of communications paper of claim 21, bearing printed indicia applied thereupon by offset lithographic printing.

23. The sheet of communications paper of claim 22, bearing printed indicia applied thereupon by inkjet printing.

24. The sheet of communications paper of claim 23, wherein said printed indicia applied thereupon by inkjet printing were applied from an anionic ink.

25. A sheet of communications paper comprising:

a) a basesheet having precipitated calcium carbonate dispersed in a cellulosic matrix, the basis weight of the basesheet being between 15 and 35 pounds per 1300 square-foot ream, said precipitated calcium carbonate being present in amount between 10 and 25% by weight of said basesheet, the caliper of said basesheet being between 3 and 7 mils;

b) said basesheet having applied thereto on at least one surface a size press coating consisting essentially of starch and an aluminum size active compound chosen from the group consisting of; (i) alum; and (ii) polyaluminum chloride, the amount of aluminum size active compound being at least 0.75% by weight of the cellulosic matrix.

26. The sheet of communications paper of claim 25, wherein the amount of starch present in said size press coating is at least 3% by weight of said cellulosic matrix.

27. The sheet of communications paper of claim 26, wherein the amount of aluminum size active compound present in said size press coating is at least 1% by weight of said cellulosic matrix.

28. The sheet of communications paper of claim 26, bearing indicia thereupon applied by a printing method using lithographic printing.

29. The sheet of communications paper of claim 28, bearing printed indicia applied thereupon by offset lithographing printing.

30. The sheet of communications paper of 29, bearing printed indicia applied thereupon by inkjet printing.

31. The sheet of communications paper of claim 30, wherein said printed indicia applied thereupon by inkjet printing were applied from an anionic ink.

32. The sheet of communications paper of claim 26, wherein the amount of aluminum size active compound present in said size press coating is between 0.75 and 2.0% by weight of said cellulosic matrix.

33. The sheet of communications paper of claim 32, bearing indicia thereupon applied by a printing method using lithographic printing.

34. The sheet of communications paper of claim 33, bearing printed indicia applied thereupon by offset lithographic printing.

35. The sheet of communications paper of 34, bearing printed indicia applied thereupon by inkjet printing.

36. The sheet of communications paper of claim 35, wherein said printed indicia applied thereupon by inkjet printing were applied from an anionic ink.

37. A sheet of communications paper comprising:

a) a basesheet having a cellulosic matrix prepared from a non-acidic furnish, the basis weight of the basesheet being between 15 and 35 pounds per 1300 square-foot ream, precipitated calcium carbonate being present in amount between 10 and 25 percent by weight of said basesheet, the caliper of said basesheet being between 3 and 7 mils per sheet;

b) said basesheet having applied thereto on at least one surface a size press coating consisting essentially of starch and a size active compound chosen from the group consisting of: (i) alum; (ii) poly aluminum chloride; (iii) sodium malate; and (iv) an admixture of sodium malate and malic acid, the amount of size active compound being at least 0.75% by weight of the cellulosic matrix.

38. The sheet of communications paper of claim 37, wherein the amount of starch present in said size press coating is at least 1.0% by weight of said cellulosic matrix.

39. The sheet of communications paper of claim 38, wherein the amount of size active compound present in said size press coating is at least 1% by weight of said cellulosic matrix.

40. The sheet of communications paper of claim 38, bearing indicia thereupon applied by lithographic printing.

41. The sheet of communications paper of claim 40, bearing printed indicia applied thereupon by offset lithographic printing.

42. The sheet of communications paper of claim 41, bearing printed indicia applied thereupon by inkjet printing.

43. The sheet of communications paper of claim 42, wherein said printed indicia applied thereupon by inkjet printing were applied from an anionic ink.

44. The sheet of communications paper of claim 38, wherein the amount of size active compound present in said size press coating is between 0.75 and 2.0% by weight of said cellulosic matrix.

45. The sheet of communications paper of claim 44, bearing indicia thereupon applied by lithographic printing.

46. The sheet of communications paper of claim 45, bearing printed indicia applied thereupon by offset lithographic printing.

47. The sheet of communications paper of claim 46, bearing printed indicia applied thereupon by inkjet printing.

48. The sheet of communications paper of claim 47, wherein said printed indicia applied thereupon by inkjet printing were applied from an anionic ink.

* * * * *